US011338531B2

(12) United States Patent
Wallace

(10) Patent No.: US 11,338,531 B2
(45) Date of Patent: May 24, 2022

(54) AUTOMATIC CAN CRUSHER APPARATUS

(71) Applicant: Michael Wallace, La Grange, NC (US)

(72) Inventor: Michael Wallace, La Grange, NC (US)

( * ) Notice: Subject to any disclaimer, the term of this patent is extended or adjusted under 35 U.S.C. 154(b) by 134 days.

(21) Appl. No.: 15/931,190

(22) Filed: May 13, 2020

(65) Prior Publication Data

US 2021/0354414 A1 Nov. 18, 2021

(51) Int. Cl.
*B30B 1/38* (2006.01)
*B30B 15/30* (2006.01)
*B30B 15/16* (2006.01)

(52) U.S. Cl.
CPC ..... *B30B 1/38* (2013.01); *B30B 15/166* (2013.01); *B30B 15/30* (2013.01)

(58) Field of Classification Search
CPC .. B30B 1/38; B30B 9/32; B30B 9/321; B30B 9/323
See application file for complete search history.

(56) References Cited

U.S. PATENT DOCUMENTS 3,636,863 A * 1/1972 Woyden ..... B30B 9/3007 100/49
4,291,618 A * 9/1981 Heiser ..... B30B 9/321 100/102
4,953,682 A 9/1990 Helbawi
5,136,934 A * 8/1992 Darby, Jr. ..... B30B 9/02 100/125
5,287,803 A 2/1994 Cole
5,333,542 A * 8/1994 Lewis ..... B30B 9/321 100/266
D360,212 S 7/1995 Zanini
5,642,661 A 7/1997 Tu
7,806,047 B1 * 10/2010 Gomez ..... B30B 9/321 100/216
8,479,647 B1 7/2013 Gomez
2016/0257088 A1 9/2016 Algea

FOREIGN PATENT DOCUMENTS

EP 0444745 9/1994

* cited by examiner

*Primary Examiner* — Matthew Katcoff

(57) ABSTRACT

An automatic can crusher apparatus for crushing cans for recycling includes a housing having a ram aperture extending through to a housing inside. A ram has a pneumatic cylinder body, a ram arm extending through the ram aperture, and a ram head coupled to the ram arm. The ram moves the ram head between a load position and a crush position adjacent a housing right side. A can positioner is coupled to a housing left side within the housing inside to secure a can adjacent the ram head in the load position. A feeder chute is coupled to the housing top side to receive a plurality of cans through a chute top end and dispense each can through a chute bottom end onto the can positioner when the ram head is in the load position.

8 Claims, 6 Drawing Sheets

AUTOMATIC CAN CRUSHER APPARATUS

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to can crushing devices and more particularly pertains to a new can crushing device for crushing cans for recycling.

(2) Description of Related Art Including Information Disclosed Under 37 CFR 1.97 and 1.98

The prior art relates to can crushing devices. Existing devices are either mechanically operated or are large machines designed for a recycling plant. Many devices require individual activation for each can rather than automatically crushing each can that passes.

(h) Brief Summary of the Invention

An embodiment of the disclosure meets the needs presented above by generally comprising a housing having a housing left side, a housing right side, a housing top side, a housing bottom side, a housing front side, and a housing back side defining a housing inside. The housing left side has a ram aperture extending through to the housing inside. A ram is coupled to the housing. The ram has a pneumatic cylinder body coupled to the housing left side, a ram arm coupled to the cylinder body and extending through the ram aperture, and a ram head coupled to the ram arm. The ram moves the ram head between a load position and a crush position adjacent the housing right side. A can positioner is coupled to the housing. The can positioner is coupled to the housing left side within the housing inside and is configured to secure a can adjacent the ram head in the load position. A feeder chute is coupled to the housing. The feeder chute is coupled to the housing top side and is configured to receive a plurality of cans through a chute top end and dispense each can through a chute bottom end onto the can positioner when the ram head is in the load position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(I) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

Figure 1:
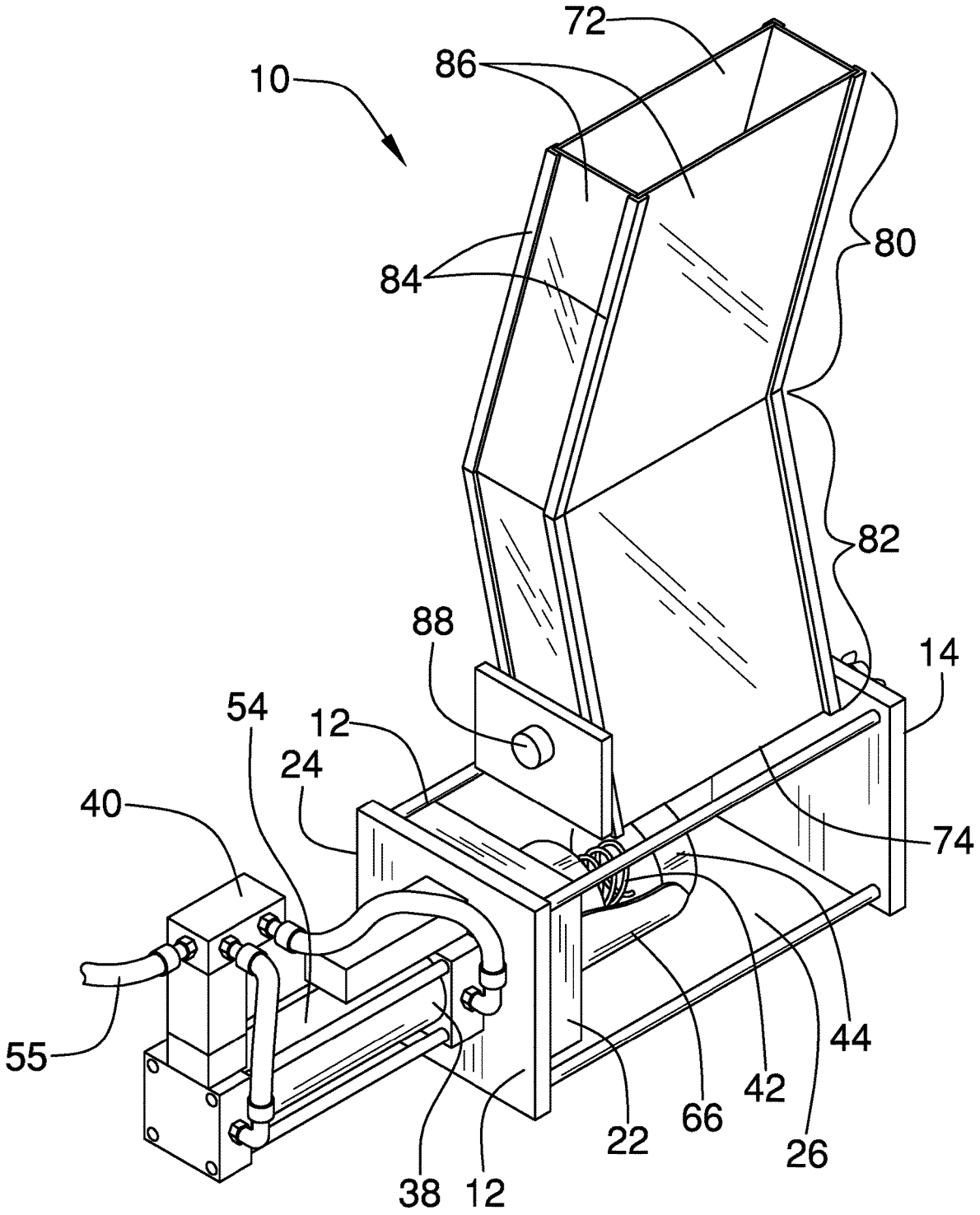
FIG. 1 is an isometric view of a automatic can crusher apparatus according to an embodiment of the disclosure.
Figure 3:
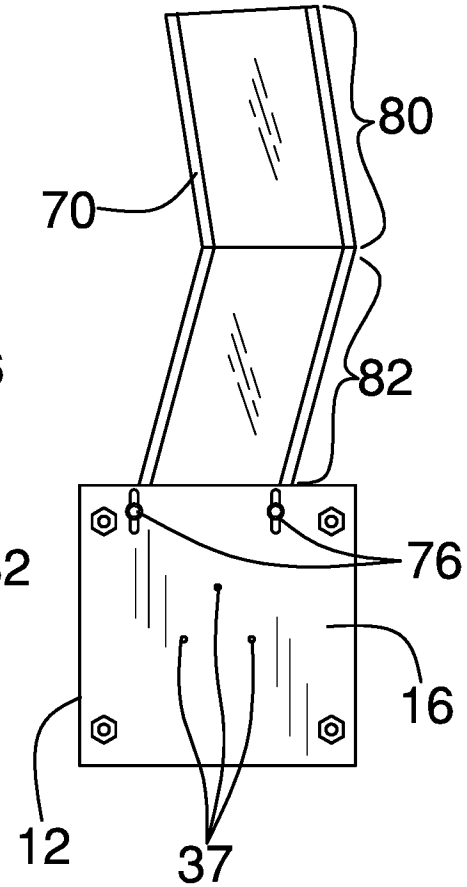
FIG. 3 is a side elevation view of an embodiment of the disclosure.
Figure 2:
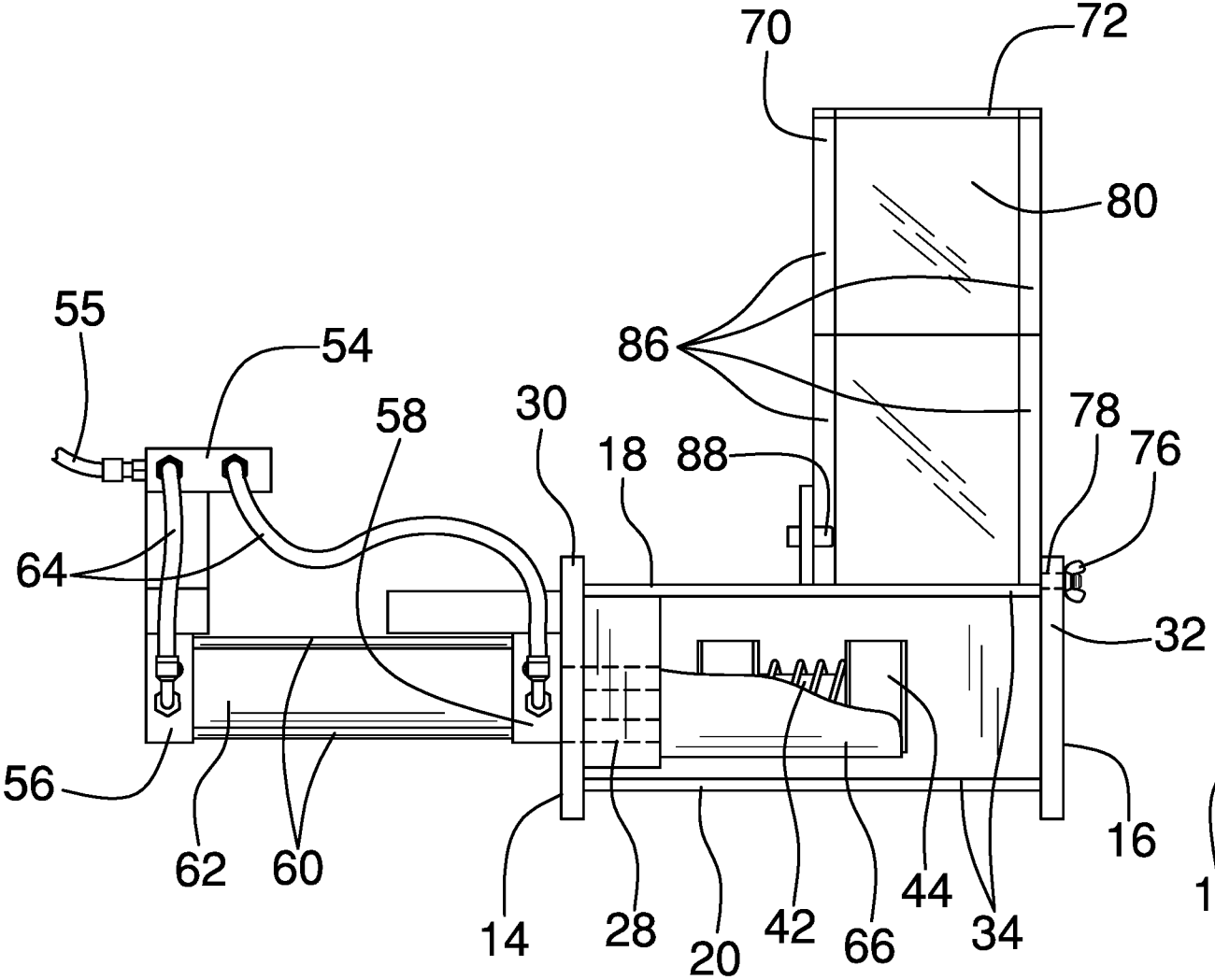
FIG. 2 is a front elevation view of an embodiment of the disclosure.
Figure 4:
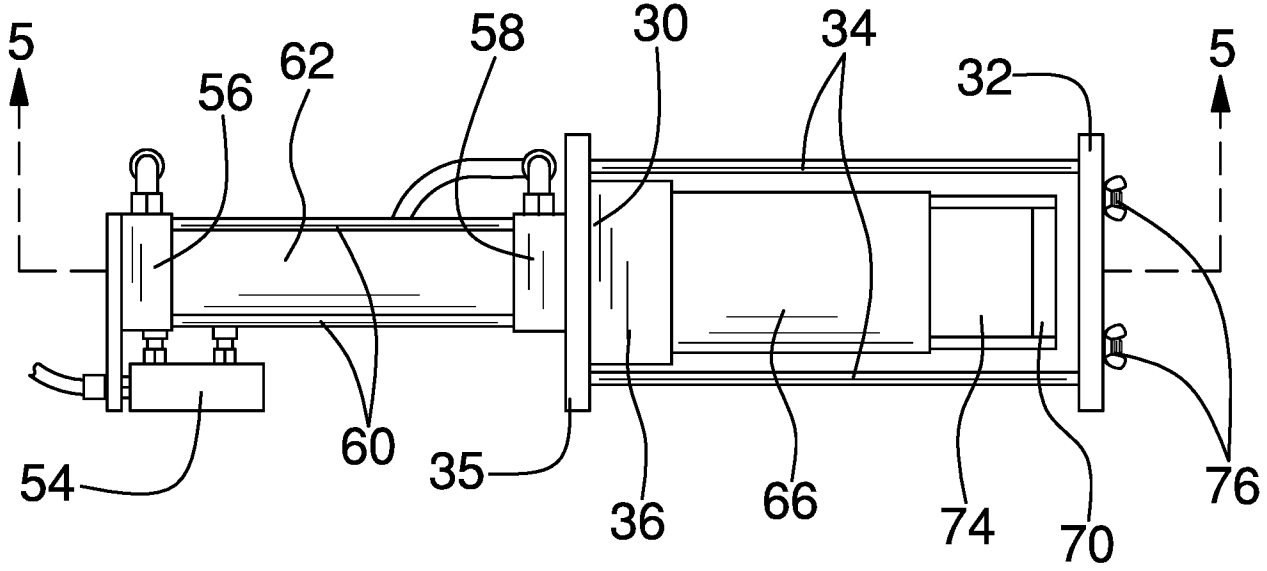
FIG. 4 is a bottom plan view of an embodiment of the disclosure.
Figure 5:
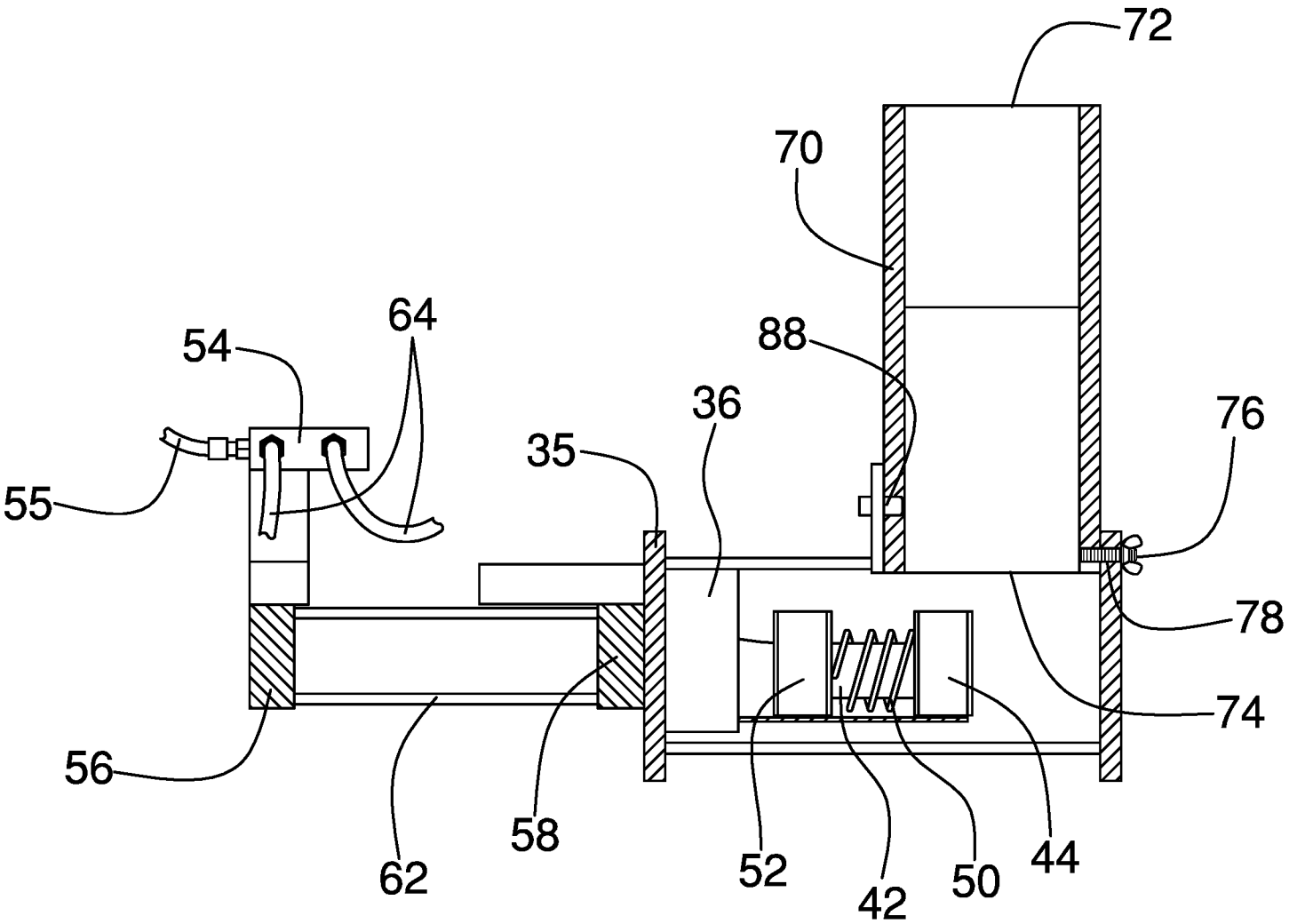
FIG. 5 is a cross-sectional view of an embodiment of the disclosure along the line 5-5 of FIG. 4.
Figure 6A:
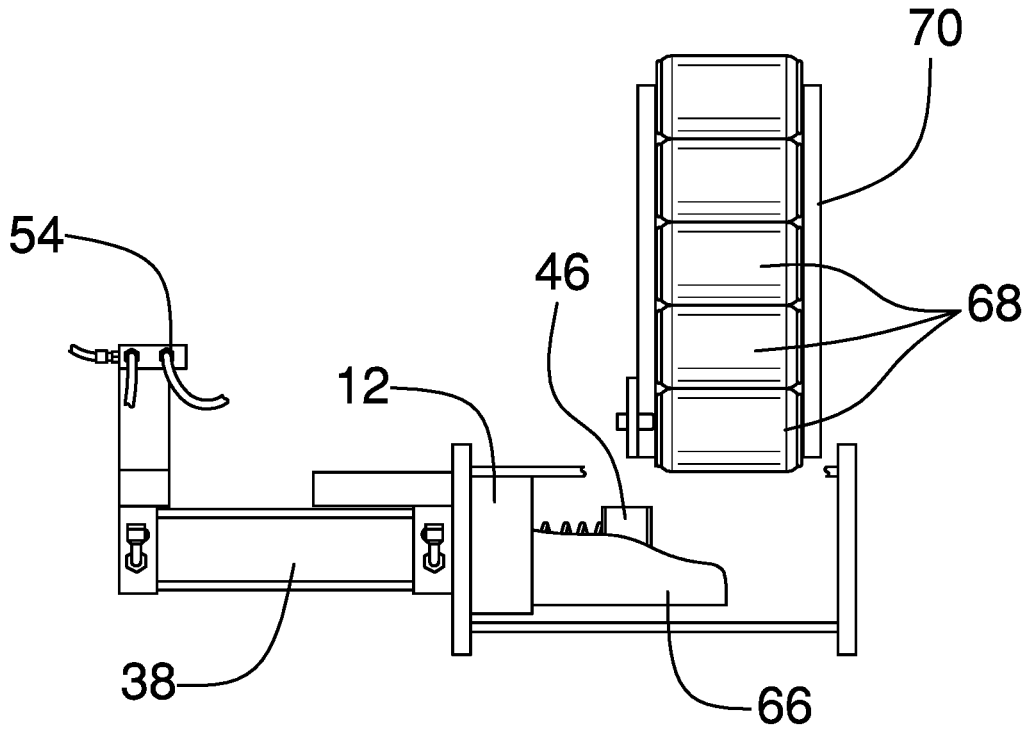

FIG. 6*a* is an in-use view of an embodiment of the disclosure.

Figure 6B:
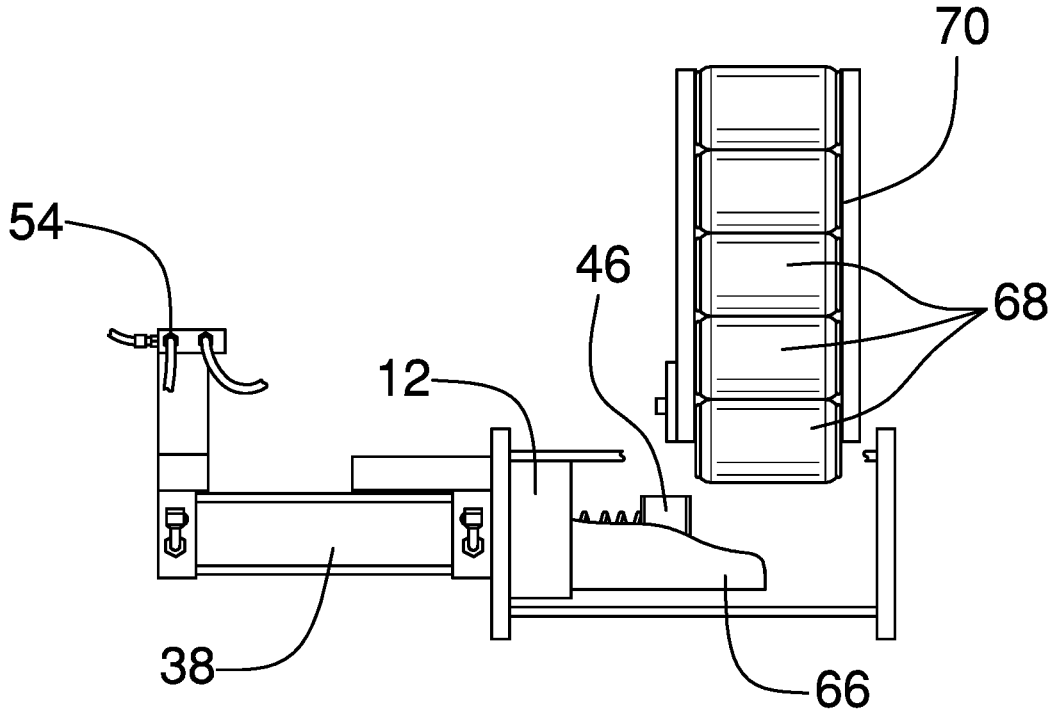

FIG. 6*b* is an in-use view of an embodiment of the disclosure.

Figure 6C:
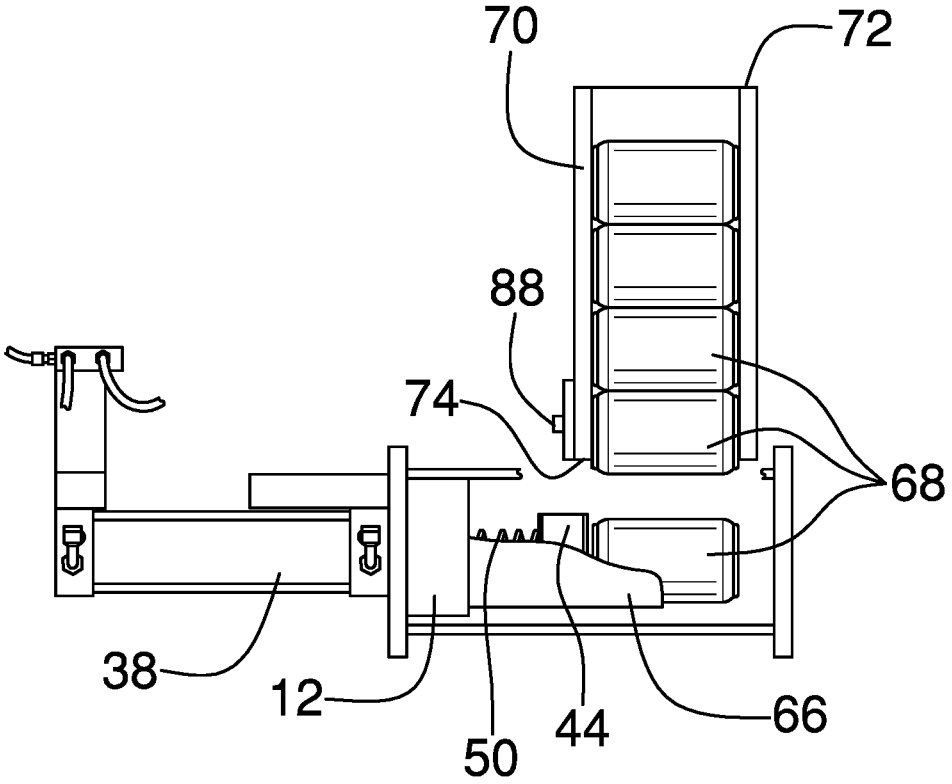

FIG. 6*c* is an in-use view of an embodiment of the disclosure.

Figure 6D:
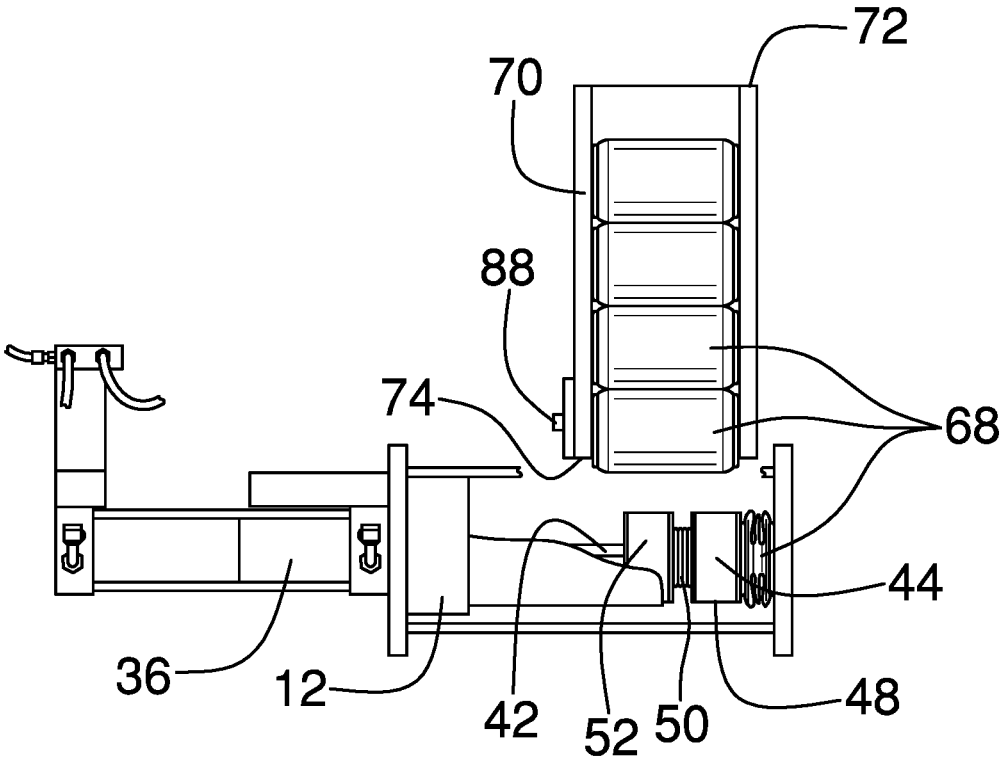

FIG. 6*d* is an in-use view of an embodiment of the disclosure.

(j) DETAILED DESCRIPTION OF THE INVENTION

With reference now to the drawings, and in particular to FIGS. 1 through 6*d* thereof, a new can crushing device embodying the principles and concepts of an embodiment of the disclosure and generally designated by the reference numeral 10 will be described.

As best illustrated in FIGS. 1 through 6*d*, the automatic can crusher apparatus 10 generally comprises a housing 12 having a housing left side 14, a housing right side 16, a housing top side 18, a housing bottom side 20, a housing front side 22, and a housing back side 24 defining a housing inside 26. The housing left side 14 has a ram aperture 28 extending through to the housing inside 26. The housing 12 may include a left housing portion 30, a right housing portion 32, and a set of housing edge rods 34 extending therebetween. The right housing portion 32 may be rectangular prismatic and the left housing portion 30 may have an outer portion 35 conforming to the left housing portion 30 and an inner portion 36. The right housing portion 32 may have a set of three vent relief apertures 37 extending therethrough.

A ram 38 is coupled to the housing 12. The ram 38 has a pneumatic cylinder body 40 coupled to the housing left side 14, a ram arm 42 coupled to the cylinder body 40 and extending through the ram aperture 28, and a ram head 44 coupled to the ram arm 42. The ram 38 moves the ram head 44 between a load position 46 and a crush position 48 adjacent the housing right side 16. The ram arm 42 may be spring-loaded with a spring 50 coiled between the ram head 44 and a spring stop 52.

The cylinder body 40 may have a two-way air valve 54 in fluid communication with the ram arm 42. The two-way air valve 54 is configured to be connected to a compressed air source 55. The cylinder body 40 may have a left cylinder mount portion 56, a right cylinder mount portion 58, a set of cylinder mount edge rods 60 extending therebetween, and a central cylindrical body portion 62 extending from the left cylinder mount portion 56 to the right cylinder mount portion 58 between the set of cylinder mount edge rods 60. The right cylinder mount portion 58 is coupled to the housing left side 14. The two-way air valve 54 may have a pair of output hoses 64 connected to the left cylinder mount portion 56 and the right cylinder mount portion 58.

A can positioner 66 is coupled to the housing left side 14 within the housing inside 26. The can positioner 66 may be a partially tubular shape coupled to the inner portion 36 of the left housing portion 30 and surrounding the ram arm 42. The can positioner 66 is configured to secure a can 68 adjacent the ram head 44 in the load position 46.

A feeder chute 70 is coupled to the housing top side 18 and configured to receive a plurality of cans 68 through a chute top end 72 and dispense each can 68 through a chute bottom end 74 onto the can positioner 66 when the ram head 44 is in the load position 46. The feeder chute 70 may have a pair of wingnuts 76 to selectively engage a pair of attachment apertures 78 of the housing right side 16. The feeder chute 70 may include an upper parallelepiped portion 80 and a lower parallelepiped portion 82 arranged at an obtuse angle to alleviate pressure on the lowest can 68 of the plurality of cans stacked in the feeder chute 70. The upper parallelepiped portion 78 and the lower parallelepiped portion 80 may form an angle between 120°-170°. The lower parallelepiped portion 80 may form an angle of 75° with the housing top side 18 and the upper parallelepiped portion 78 may form an angle of 81° with a plane parallel to the housing top side 18. Each of the upper parallelepiped portion 78 and the lower parallelepiped portion 80 may have a plurality of L-shaped edge brackets 84 and a plurality of transparent sidewalls 86 extending therebetween.

A sensor 88 is coupled to the feeder chute 70 and is in operational communication with the ram 38. The sensor 88 may be an ultrasonic sensor coupled adjacent the chute bottom end 74. The sensor 88 detects the can 68 passing to the can positioner 66 and signals the ram to move the ram head 44 from the load position to the crush position 48 and back.

In use, the plurality of cans 68 is placed into the chute top end 72. The sensor 88 and the ram 38 then function to automatically crush each can 68.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automatic can crusher apparatus comprising:

a housing having a housing left side, a housing right side, a housing top side, a housing bottom side, a housing front side, and a housing back side defining a housing inside, the housing left side having a ram aperture extending through to the housing inside, the housing including a left housing portion, a right housing portion and a set of housing edge rods extending therebetween;

a ram coupled to the housing, the ram having a pneumatic cylinder body coupled to the housing left side, a ram arm coupled to the cylinder body and extending through the ram aperture, and a ram head coupled to the ram arm, the ram moving the ram head between a load position and a crush position adjacent the housing right side;

a can positioner coupled to the housing, the can positioner being coupled to the housing left side within the housing inside, the can positioner being configured to secure a can adjacent the ram head in the load position; and a feeder chute coupled to the housing, the feeder chute being coupled to the housing top side and configured to receive a plurality of cans through a chute top end and dispense each can through a chute bottom end onto the can positioner when the ram head is in the load position, the feeder chute having an upper parallelepiped portion and a lower parallelepiped portion arranged at an obtuse angle, the upper parallelepiped portion and the lower parallelepiped portion having respective faces facing away from the housing back side and forming an angle between 120°-170°.

2. The automatic can crusher apparatus of claim 1 further comprising a sensor coupled to the feeder chute, the sensor being in operational communication with the ram.

3. The automatic can crusher apparatus of claim 2 further comprising the sensor being an ultrasonic sensor coupled adjacent the chute bottom end.

4. The automatic can crusher apparatus of claim 1 further comprising the can positioner being a partially tubular shape.

5. The automatic can crusher apparatus of claim 1 further comprising the ram arm being spring-loaded.

6. The automatic can crusher apparatus of claim 1 further comprising the cylinder body having a two-way air valve in fluid communication with the ram arm, the two-way air valve being configured to be connected to a compressed air source.

7. The automatic can crusher apparatus of claim 1 further comprising the cylinder body having a left cylinder mount portion, a right cylinder mount portion, a set of cylinder mount edge rods extending therebetween, and a central cylindrical body portion extending from the left cylinder mount portion to the right cylinder mount portion between the set of cylinder mount edge rods.

8. An automatic can crusher apparatus comprising:

a housing having a housing left side, a housing right side, a housing top side, a housing bottom side, a housing front side, and a housing back side defining a housing inside, the housing left side having a ram aperture extending through to the housing inside, the housing including a left housing portion, a right housing portion, and a set of housing edge rods extending therebetween;

a ram coupled to the housing, the ram having a pneumatic cylinder body coupled to the housing left side, a ram arm coupled to the cylinder body and extending through the ram aperture, and a ram head coupled to the ram arm, the ram moving the ram head between a load position and a crush position adjacent the housing right side, the ram arm being spring-loaded, the cylinder body having a two-way air valve in fluid communication with the ram arm, the two-way air valve being configured to be connected to a compressed air source, the cylinder body having a left cylinder mount portion, a right cylinder mount portion, a set of cylinder mount edge rods extending therebetween, and a central cylindrical body portion extending from the left cylinder mount portion to the right cylinder mount portion between the set of cylinder mount edge rods;

a can positioner coupled to the housing, the can positioner being coupled to the housing left side within the housing inside, the can positioner being a partially tubular shape, the can positioner being configured to secure a can adjacent the ram head in the load position;

a feeder chute coupled to the housing, the feeder chute being coupled to the housing top side and configured to receive a plurality of cans through a chute top end and dispense each can through a chute bottom end onto the can positioner when the ram head is in the load position, the feeder chute having an upper parallelepiped portion and a lower parallelepiped portion arranged at an obtuse angle, the upper parallelepiped portion and the lower parallelepiped portion having respective faces fixing away from the housing back side and forming an angle between 120°-170°; and a sensor coupled to the feeder chute, the sensor being in operational communication with the ram, the sensor being an ultrasonic sensor coupled adjacent the chute bottom end.

* * * * *